United States Patent [19]

Kamisada

[11] Patent Number: 4,882,461

[45] Date of Patent: Nov. 21, 1989

[54] SUBMINIATURE PUSH-BUTTON SWITCH

[75] Inventor: Koji Kamisada, Tokyo, Japan

[73] Assignee: Nihon Kaiheiki Industrial Company Ltd., Tokyo, Japan

[21] Appl. No.: 227,418

[22] Filed: Jul. 29, 1988

Related U.S. Application Data

[63] Continuation of Ser. No. 53,663, May 26, 1987, abandoned.

[30] Foreign Application Priority Data

Jun. 24, 1986 [JP] Japan ..... 61-095332

[51] Int. Cl.[4] ..... H01H 13/52

[52] U.S. Cl. ..... 200/536; 200/529

[58] Field of Search ..... 200/153 J, 339, 67 A, 200/536, 525, 529

[56] References Cited

U.S. PATENT DOCUMENTS 2,048,927 7/1936 Douglas ..... 200/153 J

FOREIGN PATENT DOCUMENTS 1104585 4/1961 Fed. Rep. of Germany ... 200/153 J

*Primary Examiner*—Renee S. Luebke

*Attorney, Agent, or Firm*—Armstrong, Nikaido, Marmelstein, Kubovcik & Murray

[57] ABSTRACT

A subminiature push-button switch has a pivot block provided below a plunger serving as an actuating member, a shaft provided either on the pivot block at its central portion between the left and right sides thereof or on an upstanding projection provided substantially at the center of a switch base, and a depression corresponding to the shaft formed either on the projection or pivot block. The pivot block is placed on the projection, in a state where the shaft and depression are in engagement with each other, so as to be freely rockable from side to side by the plunger. A movable contact attached to the pivot block is rocked from side to side by rocking the pivot block, whereby the movable contact makes and breaks contact with fixed contacts fixedly secured to the switch base.

12 Claims, 3 Drawing Sheets

SUBMINIATURE PUSH-BUTTON SWITCH

This application is a continuation of application Ser. No. 053,663 filed May 26, 1987, now abandoned.

BACKGROUND OF THE INVENTION

This invention relates to a subminiature push-button switch provided with a support mechanism in which an upstanding projection is furnished substantially at the central portion of a switch base and a pivot block is pivotally supported on the distal end of the projection.

In conventional push-button switches, support portions such as shafts or the like are provided on the front and back side faces of a pivot block, recesses are formed in step portions on the side faces of a case body, and the pivot block is supported on the case body by matching the support portions with the recesses. Alternatively, the side faces of a cover are provided with holes, shaft portions on the pivot block are inserted into the holes so that the pivot block may be rocked freely from side to side, and a movable contact resting on a common contact provided on the switch base is rocked back and forth to bring the movable contact into and out of contact with a fixed contact.

Recently, owing to miniaturization of equipment and the need for mounting on printed circuit boards, it is required that switches be subminiaturized. In addition, switches to be mounted on printed circuit boards as electrical components must be capable of being washed whole. However, in the above-described conventional push-button switches, the shafts on the front and back of the pivot block offer problems in terms of subminiaturization and washing whole. Problems also arise as to where these support portions should be arranged.

SUMMARY OF THE INVENTION

Accordingly, an object of the present invention is to provide a lightly operable subminiature push-button switch suitable for mounting on a printed circuit board, capable of being washed whole with ease and exhibiting stable contact.

According to the present invention, the foregoing object is attained by providing a subminiature pushbutton switch including a support mechanism in which an upstanding projection is furnished substantially at the central portion of a switch base and the central lower portion of a pivot block is engaged with the distal end of the projection, whereby the pivot block is pivotally supported so as to rock freely from side to side. A movable contact attached to the pivot block is rocked from side to side by the pivot block to make and break contact with a fixed contact.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the invention will now be described with reference to the drawings.

Figure 1:
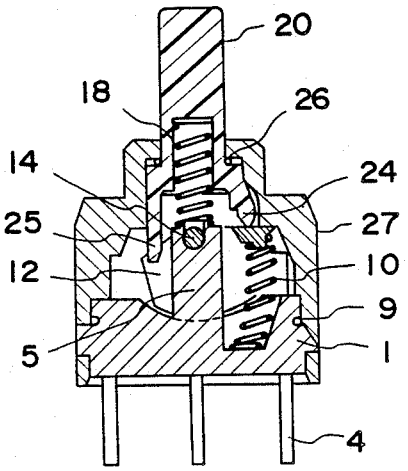
FIG. 1 is a front sectional view illustrating a first embodiment of a subminiature push-button switch according to the present invention.
Figure 2:
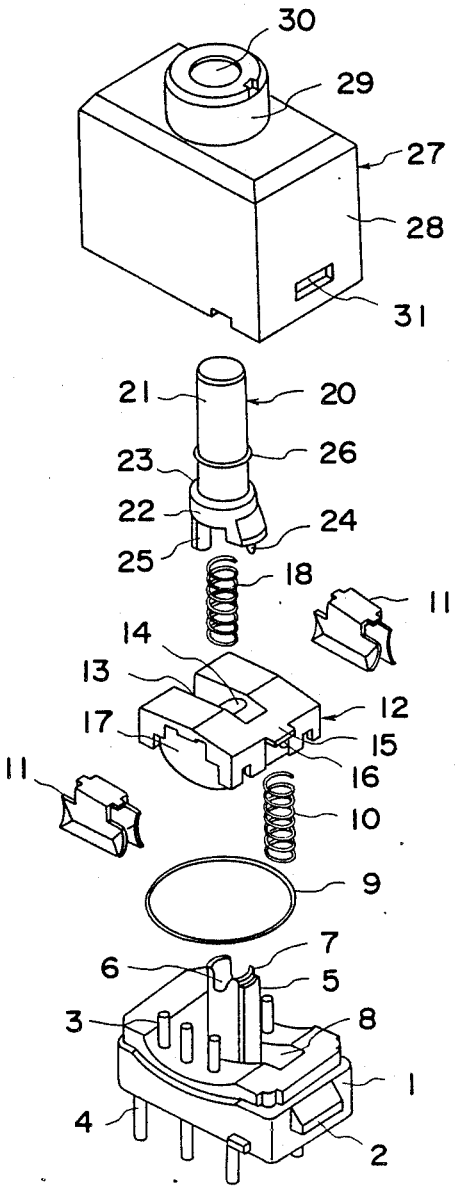
FIG. 2 is an exploded perspective view of the subminiature push-button switch of the first embodiment.
Figure 3:
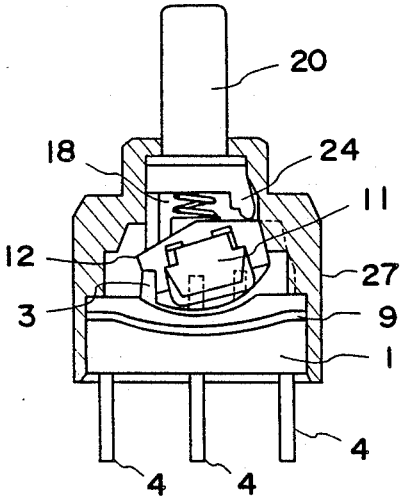
FIG. 3 is a sectional view illustrating a contact portion of the subminiature push-button switch of the first embodiment.
Figure 4:
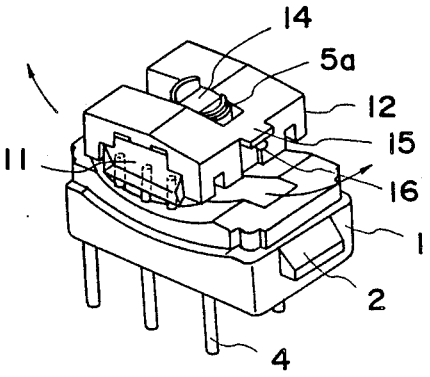
FIG. 4 is a perspective view illustrating a principal portion of the subminiature push-button switch of the first embodiment.

With reference to FIGS. 1 through 3, a first embodiment of a subminiature push-button switch according to the invention includes a switch base 1 having a depression 8 which receives the lower end of a coil spring 10 for restoring a pivot block 12, a projection 2 for fitting into a depression 31 of a switch body 27 for mounting the switch body on the switch base, fixed contacts 3, fixed terminals 4, and an upstanding projection 5 provided at substantially the central portion of the switch base 1. The upper end portion of the projection 5 is formed to include a depression 6 for receiving the pivot block 12 and a step 7 formed on the outer periphery of the upper end portion. Ordinarily, each fixed contact 3 and corresponding fixed terminal 4 are constituted by a single unitary electrically conductive member in the shape of rod. An O-ring 9 is fitted on the outer periphery of the switch base 1 to improve the waterproof and dustproof properties of the switch when the switch body 27 is mounted on the switch base 1.

The pivot block 12 has a generally C-shaped groove 13 provided in its central portion, and a shaft 14 is formed across the groove 13 at its center. The pivot block 12 is provided with a protrusion 15 on the side opposite the groove 13. Formed below the protrusion 15 is a projection 16 for receiving the upper end of the coil spring 10 which restores the pivot block 12. The front and back side faces of the pivot block 12 are provided with recesses 17 into which clip-shaped movable contacts 11 are inserted. Numeral 18 denotes a coil spring for restoring a plunger 20, which serves as the actuating member of the switch. The plunger 20 comprises a cylindrical upper portion 21, and a lower portion 22 the diameter of which is larger than that of upper portion 21. One side of the enlarged diameter lower portion 22 is provided with a projection 24 for rocking the pivot block 12 about the shaft 14. Also provided on the lower portion 22 on the side opposite the projection 24 are a depending finger 25 and a circular hole opening from below the center of the lower portion 22. One end of the coil spring 18 is fitted into the circular hole, with the other end of the spring 18 engaging the step 7 on projection 5. An upwardly facing step portion 23 is defined at the junction of the upper portion 21 and lower portion 22 of plunger 20, and the inner surface of the cylindrical portion of the switch body 27 has a downwardly facing step portion corrsponding to the step portion 23. These two step portions come into abutting contact via an O-ring 26, thereby defining an upper limit position of the plunger 20. The O-ring 26 is fitted snugly on the upwardly facing step portion 23 of the plunger 20 and serves to prevent water and dust from penetrating the interior of the switch when the plunger 20 has been installed in the switch body 27 (see FIG. 1).

The upper portion of the switch body 27 is provided with a bushing 29 having a circular bore 30, and includes a case 28 having the depression 31 formed in two of its side surfaces. When the switch body 27 is mounted on the switch base 1, the projections 2 on the switch base 1 fit into the depressions 31 to snap-fit the switch body and switch base together (see FIG. 1).

The plunger 20 is inserted in the central bore 30 of bushing 29 so as to be freely slidable up and down. The bottom face of the plunger 20 has a hole. The switch body 27 is mounted on the switch base 1 in a state where the upper end of the coil spring 18 for restoring the plunger 20 is inserted in the plunger hole, and the lower end of the coil spring 18 is in resilient contact with the step 7 on projection 5. The shaft 14 at the center of the pivot block 12 rests in depression 6 formed in the projection 5 on base 1, whereby the pivot block 12 is pivotally supported and can be rocked freely from side to side.

When the plunger 20 is depressed, the plunger descends against the spring force of the restoring coil spring 18, so that the projection 24 presses against one side of the pivot block 12, whereby the pivot block 12 is rocked about the shaft 14 against the spring force of the coil spring 10 for pivot block restoration. At this time the finger 25 depending from the plunger 20 is situated at the open portion of groove 13 in the center of the pivot block 12, thereby effectively preventing back-and-forth wobbling of the pivot block 12 when the latter is actuated. This assures that the cooperative operation between the plunger 20 and pivot block 12 will take place smoothly. As the pivot block 12 is rocked back and forth, so is the clip-shaped movable contact 11 which, as a result, makes and breaks contact with the fixed contacts 3, implanted in the switch base 1, to switch an electric circuit. When switching is completed and finger pressure is removed from the plunger 20, the pivot block 12 is restored to its initial position by the restoration force of the coil spring 10, whereby the electric circuit is switched again and the plunger 20 is restored to its upper limit position by the restoration force of the coil spring 18.

Figure 5:
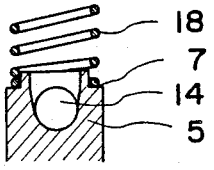
FIG. 5 is sectional side view showing a projection and plunger restoring coil spring included in the subminiature push-button switch of the first embodiment.
Figure 6:
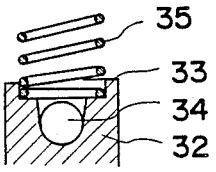
FIG. 6 is a sectional side view showing a modification of the projection and plunger restoring coil of the first embodiment.

In the above embodiment, the step portion 7 is formed on the outer periphery of the projection 5 at the upper end thereof and the lower end of the plunger restoring coil spring 18 is engaged with the step portion 7, as shown in FIG. 5. Alternatively, however, as shown in FIG. 6, an arrangement can be adopted in which a step portion 33 is formed on the inner periphery of the projection, here designated by numeral 32, and the lower end of the plunger restoring coil spring, here designated by numeral 35, is engaged with the step portion 33. Numeral 34 in FIG. 6 denotes the shaft provided on the pivot block (not shown).

A second embodiment of the present invention in which the supporting mechanism of the pivot block is modified in structure will now be described with reference to FIGS. 7 and 8.

This embodiment of the subminiature push-button switch includes a switch base 40 formed to include a central projection 44 the distal end of which is provided with a depression 45 spanned by a shaft 46. Numeral 41 denotes a projection, 42 a fixed contact, 43 a fixed terminal, and 48 a depression. These correspond to the projection 2, fixed contact 3, fixed terminal 4 and depression 8, respectively, of the first embodiment shown in FIG. 2.

The push-button switch further includes a pivot block 50 having a groove 52 formed in one side thereof. The pivot block 50 has an upper surface 51, the central portion of which is provided with a seating recess 53 for receiving the lower end of a plunger restoring coil spring 62. The lower side of the pivot block 50 opposing the seating recess 53 is provided with a depression 57 which engages the shaft 46. Numeral 54 denotes a protrusion, 55 a projection provided below the protrusion 55, 56 a recess, 58 a movable contact, 60 an O-ring, 61 a pivot block restoring coil spring, 62 the aforementioned plunger restoring coil spring, 63 a plunger, 64 a projection, 65 a depending finger, and 66 and O-ring. These correspond to the similarly named components of the first embodiment.

Figure 7:
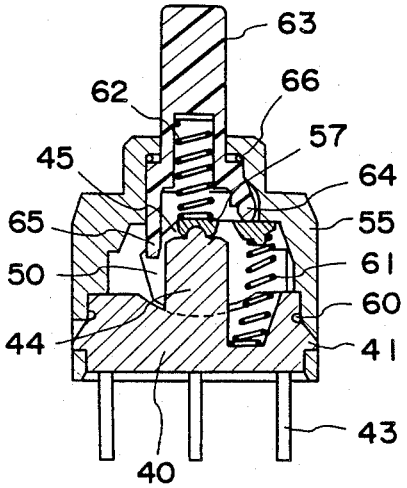
FIG. 7 is a front sectional view illustrating a second embodiment of a subminiature push-button switch according to the present invention.
Figure 8:
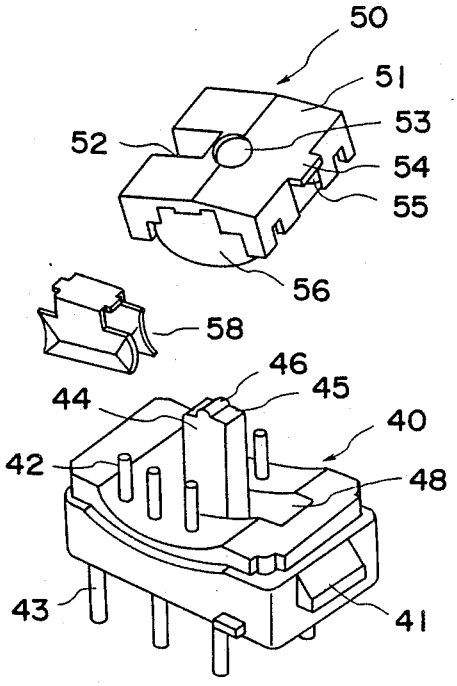
FIG. 8 is an exploded perspective view of portions of the subminiature push-button switch of the second embodiment.

When assembled, the push-button switch has the form shown in FIG. 7. When the plunger 63 is depressed, the plunger descends against the spring force of the restoring coil spring 62, so that the projection 64 presses against one side of the pivot block 50, whereby the pivot block 50 is rocked about the shaft 46 against the spring force of the coil spring 61 for pivot block restoration. At this time the finger 65 depending from the plunger 63 is situated at the open portion of groove 52 of the pivot block 50. As the pivot block 50 is rocked back and forth, so is the clip-shaped movable contact 58 which, as a result, makes and breaks contact with the fixed contacts 42, implanted in the switch base 40, to switch an electric circuit. When switching is completed and finger pressure is removed from the plunger 63, the pivot block 50 is restored to its initial position by the restoration force of the coil spring 61, whereby the electric circuit is switched again and the plunger 63 is restored to its upper limit position by the restoration force of the coil spring 62.

The present invention is not limited to the abovedescribed embodiments but can be modified in various ways based on the gist of the invention without departing from the scope of the claims.

The present invention described in detail above has the following advantages:

(1) It is possible to construct a novel push-button switch, which differs entirely from the conception of conventional push-button switches, and which can be made much smaller than these conventional switches. Specifically, a shaft is provided either on the pivot block at its central portion between the left and right sides thereof or on the projection provided substantially at the center of the switch base, and a depression corresponding to the shaft is formed either on the projection or pivot block. The pivot block is placed on the projection, in a state where the shaft and depression engage each other, so as to be freely rockable from side to side. This makes it possible to greatly simplify and miniaturize the structure of the switch. In particular, the width of the switch can be made very small.

(2) The switch is well-suited for mounting on a printed circuit board and can be washed whole with ease. This enhances the function of the switch as a component part for mounting on a printed circuit board.

(3) The center of rocking motion of the pivot block is focused on the distal end of the projection upstanding from the switch base at the central portion of the switch body. This makes it possible to achieve light operation with an excellent switching sensation.

(4) A sliding contact-type contact arrangement is adopted in which use is made of a clip-shaped movable contact mounted on the pivot block rocked about the distal end of the projection upstanding from the switch base. As a result, the range of rocking motion can be widened despite the miniaturization of the switch, and there is no bounce-back caused by impact when contacts are switched. In addition, the movable contact performs a self-cleaning action at all times due to its sliding motion, so that stable contact can be maintained over an extended period of time. Thus, a subminiature push-button switch having a long service life can be obtained.

(5) The coil spring for restoring the pivot block is arranged between the lower surface of the pivot block and the upper surface of the switch base, thereby assuring restoration of the pivot block and providing a highly reliable switching operation.

(6) The plunger restoring coil spring engages the engaging portion of the projection on the switch base from above the pivot block. This effectively prevents the pivot block from being lifted or dislodged by impact or the like.

What we claim is:

1. A subminiature push-button switch comprising:

a switch base having a plurality of fixed contacts secured thereto and a central portion;

an upstanding bar-shape projection provided on said switch base at said central portion, said upstanding bar-shape projection having a distal end opposite to said switch base, said distal end having a first engagement section;

a pivot block placed upon said upstanding bar-shape projection, said pivot block having a vertical through groove at a central portion thereof and a second engagement section positioned at an upper part of said vertical through groove, said pivot block being pivotally supported on said distal end of said projection by inserting said upstanding bar-shape projection into said vertical through groove until said first engagement section engages with said second engagement section such that a lower part of said pivot block opposite to said second engagement swings toward and away from said upstanding bar-shape projection;

at least one movable contact attachable to said pivot block;

a vertically movable plunger for rocking said pivot block from side to side, said at least one movable contact being rocked from side to side in response to a swing motion of said pivot block;

a first spring means provided immediately under said plunger and above said second engagement section for urging said plunger away from said pivot block and for preventing said first and second engagement sections from disengaging from each other in a manner such that said first spring substantially does not swing along with the swing movement of said pivot block; and a second spring means for urging said pivot block to generate rocking motion, wherein said plunger, first spring means and said upstanding bar-shape projection are coaxially aligned.

2. The subminiature push-button switch according to claim 1, wherein said at least one movable contract comprises a clip-shaped flexible member and is arranged on a side portion of said pivot block.

3. The subminiature push-button switch according to claim 1, wherein said second spring means is a coil spring.

4. The subminiature push-button switch according to claim 1, wherein said vertically movable plunger has a depending finger projecting toward and into said vertical through groove.

5. The subminiature push-button switch according to claim 1, wherein said first engagement section is a shaft provided at said distal end of said upstanding projection and said second engagement section has a depression riding on said shaft.

6. The subminiature push-button switch according to claim 5, wherein said first spring means directly engages upon said second engagement section at a side thereof opposite to said depression.

7. The subminiature push-button switch according to claim 1, wherein said first engagement section is a depression provided on said distal end of said upstanding projection and said second engagement is a shaft riding on said depression.

8. The subminiature push-button switch according to claim 7, wherein said depression is surrounded by a circumferential periphery and said first spring means is positioned on said circumferential periphery of said depression such that said shaft does not dislocate out of said depression.

9. The subminiature push-button switch according to claim 8, wherein said circumferential periphery has a step portion where said first spring means engages.

10. The subminiature push-button switch according to claims 9, wherein said first spring means is a coil spring.

11. The subminiature push-button switch according to claim 10, wherein said step portion is provided at an outer circumferential side of said distal end of said upstanding projection and a distal end of said coil spring engages on said step portion.

12. The subminiature push-button switch according to claim 10, wherein said step portion is provided immediately above and within said depression and a distal end of said coil spring engages on said step portion.

* * * * *